US009457578B2

(12) United States Patent
Furukawa

(10) Patent No.: US 9,457,578 B2
(45) Date of Patent: Oct. 4, 2016

(54) INKJET RECORDING APPARATUS

(71) Applicant: KYOCERA Document Solutions Inc., Osaka (JP)

(72) Inventor: Noriaki Furukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/887,574

(22) Filed: Oct. 20, 2015

(65) Prior Publication Data

US 2016/0114587 A1 Apr. 28, 2016

(30) Foreign Application Priority Data

Oct. 27, 2014 (JP) ..... 2014-218408

(51) Int. Cl.
*B41J 2/165* (2006.01)

(52) U.S. Cl.
CPC ..... *B41J 2/16535* (2013.01); *B41J 2/16538* (2013.01); *B41J 2/16544* (2013.01)

(58) Field of Classification Search
CPC ..... B41J 2/16535; B41J 2002/16552
See application file for complete search history.

(56) References Cited

U.S. PATENT DOCUMENTS 5,640,182 A * 6/1997 Bahrami ..... B41J 2/1652 347/33
2004/0130589 A1* 7/2004 Nagase ..... B41J 2/16535 347/33
2007/0115318 A1* 5/2007 Nishizaki ..... B41J 2/16508 347/33
2009/0189945 A1* 7/2009 Sekiyama ..... B41J 2/16547 347/33
2013/0222474 A1* 8/2013 Williamson ..... B41J 2/16538 347/33

FOREIGN PATENT DOCUMENTS

JP 2001-071513 A 3/2001
JP 2005040976 A * 2/2005
JP 2005153183 A * 6/2005

OTHER PUBLICATIONS

Machine generated English translation of JP2005-153183 to Namekawa et al., "Cleaning Blade for Liquid Ejector, Cleaning Mechanism With Ceaning Blade, Liquid Ejection Cartridge, and Liquid Ejector." Translation retrieved from https://www4.j-platpat.inpit.go.jp/eng/tokujitsu/tkbs_en/TKBS_EN_GM101_Top.action on Mar. 10, 2016; 13pp.*

* cited by examiner

*Primary Examiner* — Shelby Fidler
(74) *Attorney, Agent, or Firm* — Studebaker & Brackett PC

(57) ABSTRACT

An inkjet recording apparatus includes a recording head having an ink discharge surface, a wiper blade that cleans the ink discharge surface of the recording head, and a controller. The controller causes the wiper blade to wipe ink off the ink discharge surface by causing the wiper blade to be pushed against the ink discharge surface and move. The wiper blade includes an ink carrying surface and a protrusion having an ink retaining surface. The ink retaining surface inclines at a predetermined angle relative to the ink carrying surface and is connected to the ink carrying surface. The ink retaining surface curves such that a distance from the ink retaining surface toward a tip end of the wiper blade increases from a central part toward opposite ends of the wiper blade in a width direction of the wiper blade.

9 Claims, 7 Drawing Sheets

INKJET RECORDING APPARATUS

INCORPORATION BY REFERENCE

The present application claims priority under 35 U.S.C. §119 to Japanese Patent Application No. 2014-218408, filed on Oct. 27, 2014. The contents of this application are incorporated herein by reference in their entirety.

BACKGROUND

The present disclosure relates to inkjet recording apparatuses.

An inkjet recording apparatus has been known that includes a wiper blade for cleaning an ink discharge surface of a recording head. The ink discharge surface is a surface where ink discharging nozzles are disposed. The inkjet recording apparatus moves the wiper blade in a predetermined direction while pushing the wiper blade against the ink discharge surface, thereby wiping ink attached to the ink discharge surface.

For example, the wiper blade of the inkjet recording apparatus includes a ribbed member on a tip end thereof. As such, even in a configuration in which the ink discharge surface of the inkjet recording apparatus has a recess, responsive movement of tip end part of the wiper blade in accordance with the shape of the recess can be ensured and wiping performance can be secured.

SUMMARY

An inkjet recording apparatus according to an aspect of the present disclosure includes a recording head having an ink discharge surface and configured to discharge ink onto a recording medium, a wiper blade configured to clean the ink discharge surface of the recording head, and a controller. The controller is configured to cause the wiper blade to wipe ink off the ink discharge surface by causing the wiper blade to be pushed against the ink discharge surface and move in a first direction and a second direction opposite to the first direction. The wiper blade has a first ink carrying surface, a second ink carrying surface, and a protrusion. The first ink carrying surface extends in a direction perpendicular to the first direction and configured to carry ink on the ink discharge surface while the wiper blade moves in the first direction. The second ink carrying surface extends in a direction perpendicular to the second direction and configured to carry ink on the ink discharge surface while the wiper blade moves in the second direction. The protrusion protrudes in the first direction from the first ink carrying surface and has an ink retaining surface. The ink retaining surface is inclined at a predetermined angle relative to the first ink carrying surface and connected to the first ink carrying surface. The ink retaining surface curves such that a distance from the ink retaining surface to a tip end of the wiper blade increases from a central part toward opposite ends of the wiper blade in a width direction of the wiper blade. The width direction of the wiper blade is perpendicular to the first direction and parallel to the ink discharge surface.

DETAILED DESCRIPTION

Figure 1:
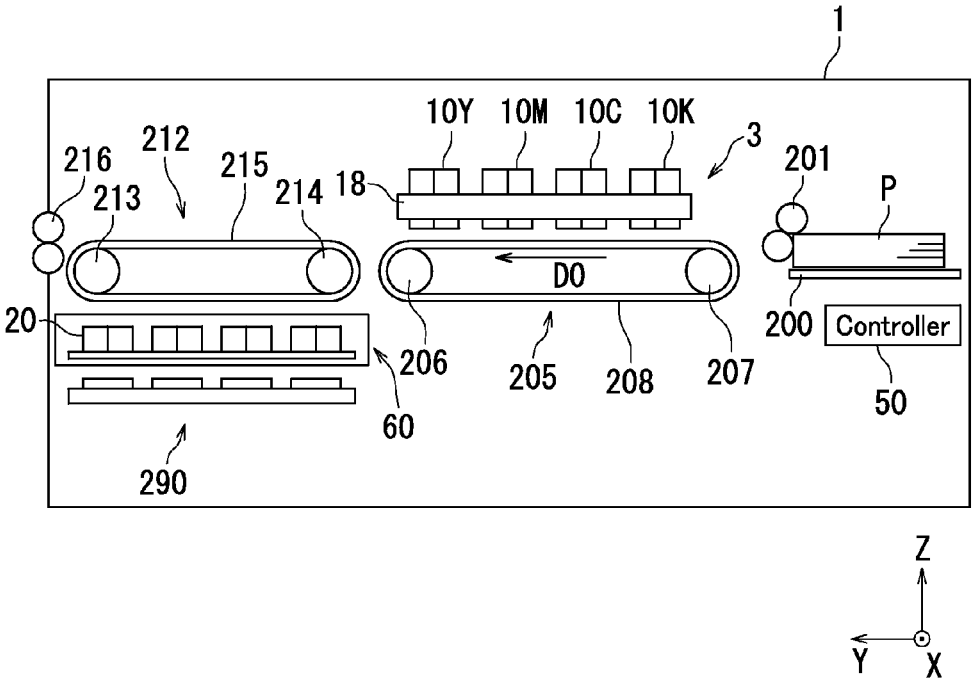
FIG. 1 is a diagram illustrating a configuration of an inkjet recording apparatus according to an embodiment.

An embodiment of the present disclosure will be described below with reference to the accompanying drawings. Note that the embodiment described below is not intended to limit the disclosure of the appended claims. Also note that not all of the elements described in the following embodiments are essential to achievement of the advantages of the present disclosure. Like reference signs denote like elements through the drawings. In the embodiments, X, Y, and Z axes in the drawings are perpendicular to one another.

FIG. 1 is a diagram illustrating a configuration of an inkjet recording apparatus 1 according to the embodiment.

The inkjet recording apparatus 1 includes a tray 200, a feed roller 201, a first conveyance unit 205, a head portion 3, a second conveyance unit 212, an ejection roller 216, a wiper unit 60, a capping unit 290, and a controller 50.

Paper P is placed on the tray 200 as a recording medium. The tray 200 is disposed upstream (on the right side in FIG. 1) of the first conveyance unit 205 in terms of a conveyance direction D0 of the paper P. The feed roller 201 is disposed at a downstream end of the tray 200 in terms of the paper conveyance direction D0. The feed roller 201 feeds the paper P placed on the tray 200 to the first conveyance unit 205 on a sheet-by-sheet basis.

A first conveyance belt 208 of the first conveyance unit 205 receives loading of the paper P fed from the feed roller 201 and conveys the paper P in the paper conveyance direction D0 (leftward in FIG. 1). The first conveyance unit 205 includes a first drive roller 206, a first driven roller 207, and the first conveyance belt 208. The first conveyance belt 208 is wound between the first drive roller 206 and the first driven roller 207. Upon a motor (not illustrated) driving to rotate the first drive roller 206, the first conveyance belt 208 is circulated, thereby conveying the paper P loaded on the first conveyance belt 208 in the paper conveyance direction D0.

Figure 2:
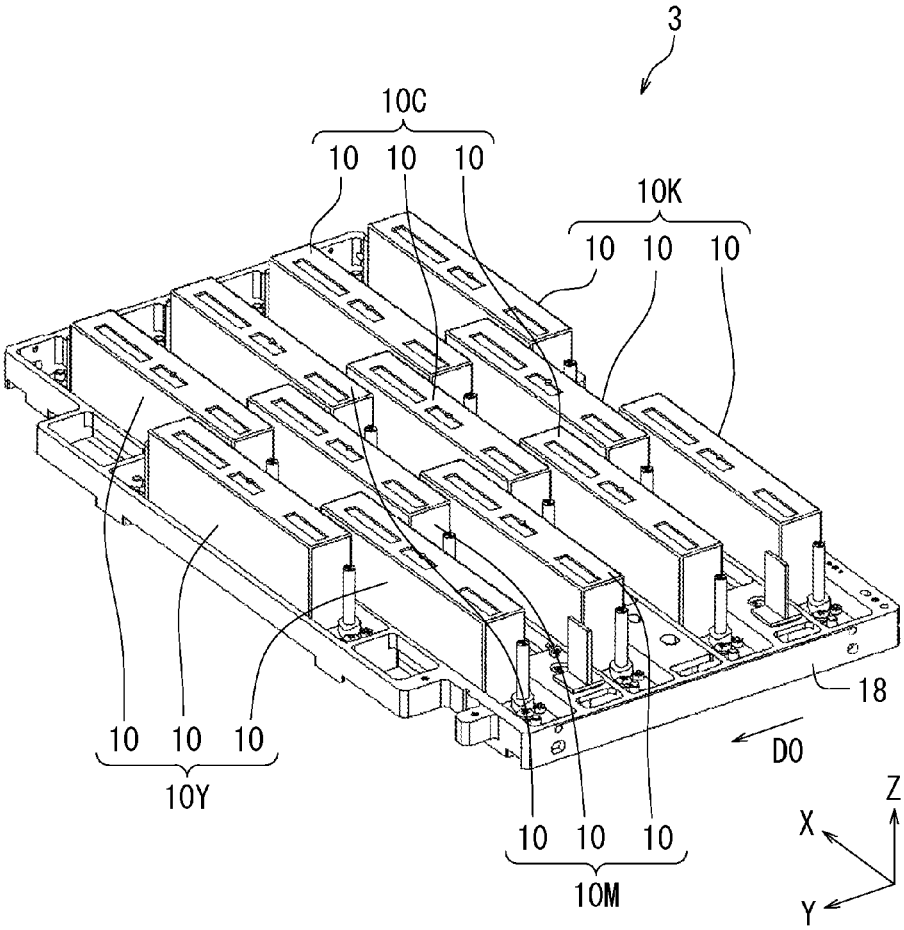
FIG. 2 is a perspective view of a head portion according to the embodiment.

The head portion 3 is disposed opposite to the first conveyance unit 205. The head portion 3 discharges ink onto the paper P conveyed by the first conveyance unit 205 to form an image on the paper P. With reference to FIGS. 2 and 3, description will be made below about configurations of the head portion 3 and recording heads 10 included in the head portion 3.

FIG. 2 is a perspective view of the head portion 3 according to the embodiment.

The head portion 3 includes a head housing 18 and different types (four types in the present embodiment) of line heads 10Y, 10M, 10C, and 10K. The line head 10Y is a line head for yellow color. The line head 10M is a line head for magenta color. The line head 10C is a line head for cyan color. The line head 10K is a line head for black color.

The plural types of line heads 10Y, 10M, 10C, and 10K are held by the head housing 18. The line heads 10Y, 10M, 10C, and 10K are arranged in the order of the line heads 10K, 10C, 10M, and 10Y from upstream to downstream in terms of the paper conveyance direction D0. In the present embodiment, the line heads 10Y, 10M, 10C, and 10K each include three recording heads 10 disposed in a staggered formation in a direction perpendicular to the paper conveyance direction D0 (an X axis direction in the present embodiment). The three recording heads 10 of the line head 10Y discharge yellow ink. The three recording heads 10 of the line head 10M discharge magenta ink. The three recording heads 10 of the line head 10C discharge cyan ink. The three recording heads 10 of the line head 10K discharge black ink.

Figure 3A:
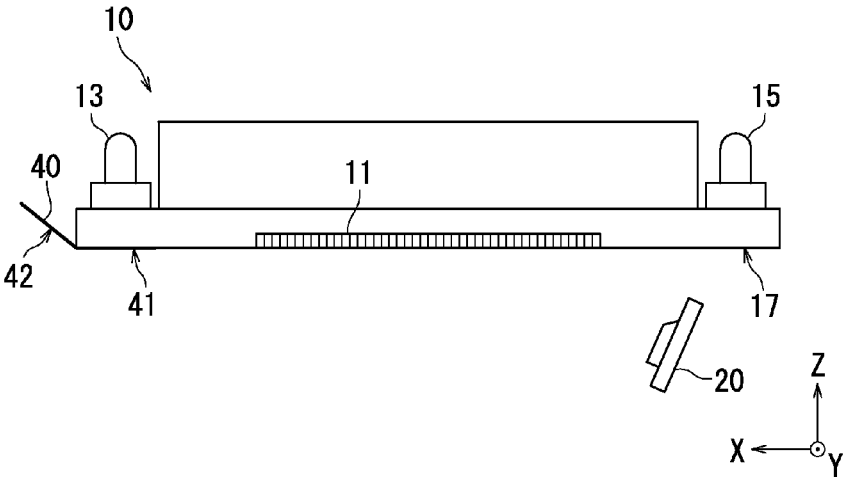
FIG. 3A is a side view of a recording head according to the embodiment.
Figure 3B:
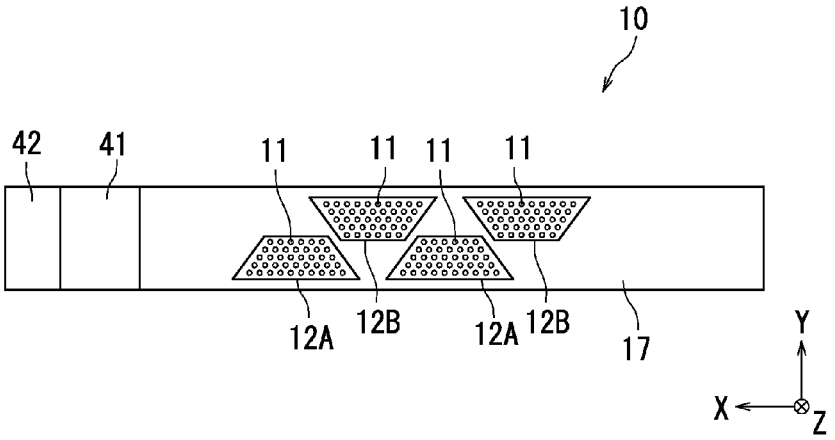
FIG. 3B is a bottom view of the recording head according to the embodiment.

FIG. 3A is a side view of a recording head 10 according to the embodiment. FIG. 3B is a bottom view of the recording head 10 according to the embodiment.

As illustrated in FIG. 3A, the recording head 10 includes a plurality of nozzles 11, an ink inlet 13, and an ink outlet 15. The ink outlet 15 is disposed at one side end of the recording head 10 (the ink discharge surface 17) in the longitudinal direction (the right end in FIGS. 3A and 3B, hereinafter referred to as a first end). The ink inlet 13 is disposed at the other side end of the recording head 10 (the ink discharge surface 17) in the longitudinal direction (the left end in FIGS. 3A and 3B, hereinafter referred to as a second end). In the present embodiment, the longitudinal direction of the recording head 10 coincides with an X axis.

A surface of the recording head 10 where the plurality of nozzles 11 are disposed is an ink discharge surface 17. The nozzles 11 are disposed at the central part of the ink discharge surface 17 in the longitudinal direction. The nozzles 11 discharge ink for forming an image on paper P. Further, the nozzles 11 release ink together with foreign matter within the recording head 10 in purging. Ink to be discharged in image formation or released in purging by the nozzles 11 flows into the recording head 10 from an ink tank (not illustrated) via the ink inlet 13. The ink tank prevents evaporation of a volatile component contained in the ink. Ink discharged or released from the nozzles 11 is fresh ink.

A plate-like member 40 bent in an L-shape is disposed at the second end of the ink discharge surface 17. The plate-like member 40 has a hydrophilic portion 41 (an ink retaining portion) and a repellent portion 42. The hydrophilic portion 41 is disposed on the ink discharge surface 17. The hydrophilic portion 41 has hydrophilicity higher than the ink discharge surface 17. The hydrophilic portion 41 is made from metal such as stainless steel, or synthetic resin, for example. The repellent portion 42 is disposed obliquely upward relative to the ink discharge surface 17. The repellent portion 42 has repellency higher than the ink discharge surface 17 and the hydrophilic portion 41. The repellent portion 42 is made from fluororesin, for example.

As illustrated in FIG. 3B, the ink discharge surface 17 has a plurality of nozzle regions (two first nozzle regions 12A and two second nozzle regions 12B in the present embodiment). A plurality of nozzles 11 are disposed throughout each of the nozzle regions 12A and 12B.

The first nozzle regions 12A each have a trapezoidal shape having a base at one side (a lower side in FIG. 3B) of the ink discharge surface 17 in the width direction of the ink discharge surface 17 (a direction perpendicular to the longitudinal direction of the ink discharge surface 17) and another base at a central part of the ink discharge surface 17 in the width direction. The second nozzle regions 12B each have a trapezoidal shape having a base at the other side (an upper side in FIG. 3B) of the ink discharge surface 17 in the width direction and another base at the central part of the ink discharge surface 17 in the width direction. The first and second nozzle regions 12A and 12B are arranged alternately in the longitudinal direction of the ink discharge surface 17. In the arrangement of the nozzle regions 12A and 12B as above, the number of nozzles 11 disposed in the central part of the ink discharge surface 17 in the width direction is slightly larger than that of nozzles 11 disposed on each opposite side end part of the ink discharge surface 17 in the width direction.

Referring back to FIG. 1, description will be continued about the inkjet recording apparatus 1. The second conveyance unit 212 is disposed downstream (on the left side in FIG. 1) of the first conveyance unit 205 in terms of the paper conveyance direction D0. The second conveyance unit 212 includes a second drive roller 213, a second driven roller 214, and a second conveyance belt 215. The second conveyance belt 215 is wound between the second drive roller 213 and the second driven roller 214. Upon a motor (not illustrated) driving to rotate the second drive roller 213, the second conveyance belt 215 is circulated, thereby conveying paper P loaded on the second conveyance belt 215 in the paper conveyance direction D0.

The paper P on which an image is formed by the head portion 3 is fed to the second conveyance unit 212. During passing of the paper P through the second conveyance unit 212, ink attached to the surface of the paper P is dried. The ejection roller 216 ejects the paper P conveyed by the second conveyance unit 212 outside the inkjet recording apparatus 1.

The wiper unit 60 and the capping unit 290 are disposed below the second conveyance unit 212. The wiper unit 60 wipes ink attached to the ink discharge surface 17 of the recording head 10 using a wiper blade 20. The capping unit 290 is fitted on the ink discharge surface 17 of the recording head 10 in a situation in which the recording head 10 is not used for a predetermined time period or longer. The above configuration can prevent ink in the recording head 10 from being dried. The configuration of the wiper unit 60 will be described later in detail with reference to FIG. 4.

The controller 50 controls operation of the entire inkjet recording apparatus 1. The controller 50 includes a central processing unit (CPU) and a memory. The memory stores therein various types of computer programs that are executed by the CPU. Functions of the controller 50 are implemented through execution of the various computer programs in the memory by the CPU.

The controller 50 causes the wiper unit 60 to wipe the ink discharge surface 17. Specifically, the controller 50 causes the wiper blade 20 to wipe ink off the ink discharge surface 17 by causing the wiper blade 20 to be pushed against the ink discharge surface 17 and move in a predetermined direction. Note that the controller 50 causes the first conveyance unit 205 to descend before the wiper unit 60 wipes the ink discharge surface 17. The controller 50 then causes the wiper unit 60 to move horizontally to a standby position below the head portion 3 (a location between the head portion 3 and the first conveyance unit 205).

Before the ink discharge surface 17 of the recording head 10 is capped, the controller 50 causes the first conveyance unit 205 to descend. The controller 50 then causes the capping unit 290 to move horizontally below the head portion 3. The controller 50 then causes the capping unit 290 to move upward and be fitted on the ink discharge surface 17 of the recording head 10.

Figure 4:
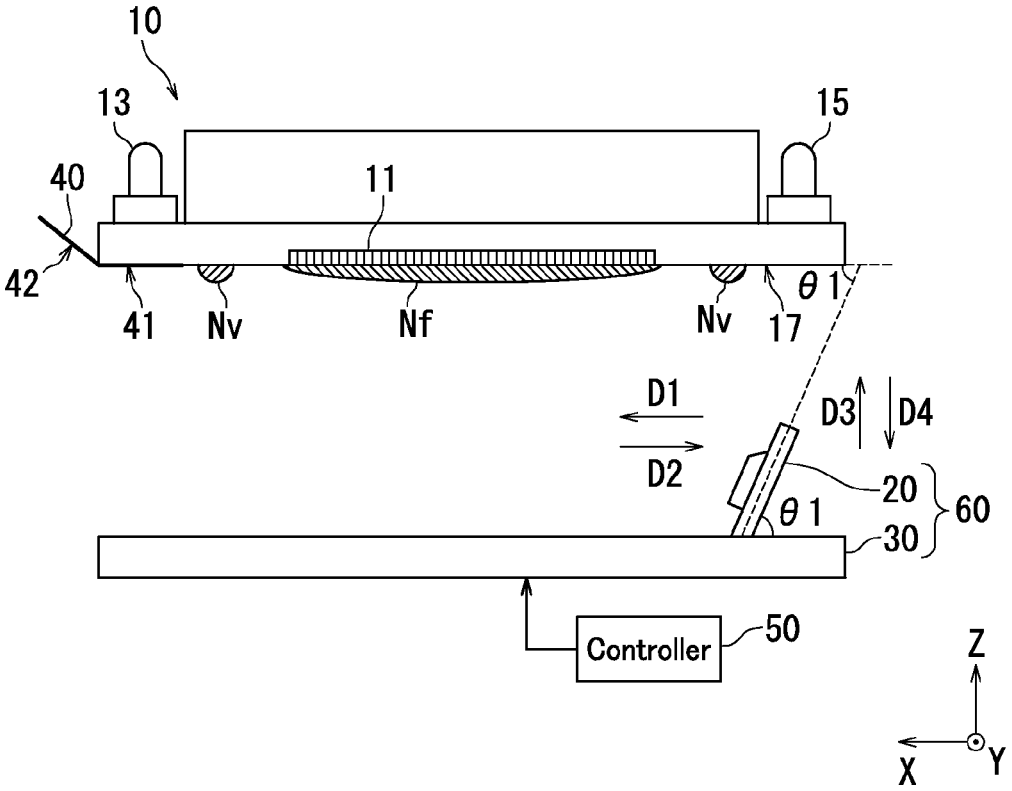
FIG. 4 is a diagram illustrating a configuration of a wiper unit according to the embodiment.

FIG. 4 is a diagram illustrating a configuration of the wiper unit 60 according to the embodiment.

The wiper unit 60 includes the wiper blade 20 and a movement mechanism 30. Only one wiper blade 20 is illustrated in FIG. 4 for the sake of convenience. However, the wiper unit 60 includes a plurality of wiper blades 20 each for one of the plurality of recording heads 10. The wiper blades 20 each wipe the ink discharge surface 17 of a corresponding one of the recording heads 10. The configuration of the wiper blade 20 will be described later in detail with reference to FIGS. 7A and 7B.

The movement mechanism 30 moves the wiper blade 20 in accordance with an instruction from the controller 50. In the present embodiment, the movement mechanism 30 is capable of moving the wiper blade 20 in a first wiping direction D1 (a first direction), a second wiping direction D2 (a second direction), an ascending direction D3, and a descending direction D4. The first wiping direction D1 and the second wiping directions D2 opposite to the first wiping direction D1 coincide with a direction of the X axis. The ascending direction D3 and the descending direction D4 opposite to the ascending direction D3 coincide with the direction of the Z axis.

The wiper blade 20 is disposed on the movement mechanism 30 aslant at an angle θ1 less than 90 degrees (e.g., 70 degrees) between the ink discharge surface 17 and a central axis of the wiper blade 20 indicated by a dashed line in FIG. 4. In other words, the central axis of the wiper blade 20 is inclined at an angle (90 degrees-θ1) relative to the Z axis. Specifically, the wiper blade 20 is disposed on the movement mechanism 30 aslant such that a tip end of the wiper blade 20 is located ahead (on the right side in FIG. 4) relative to a base end of the wiper blade 20 in the second wiping direction D2. The angle θ1 is preferably in a range from 60 degrees to 80 degrees.

In the configuration in which the wiper blade 20 is disposed aslant on the movement mechanism 30, the tip end part of the wiper blade 20 can be prevented from buckling upon the wiper blade 20 moving in the ascending direction D3 and coming into contact with the ink discharge surface 17.

FIGS. 5A-5D and 6A-6D are diagrams illustrating an operation of the wiper blade 20 according to the embodiment.

Figure 5A:
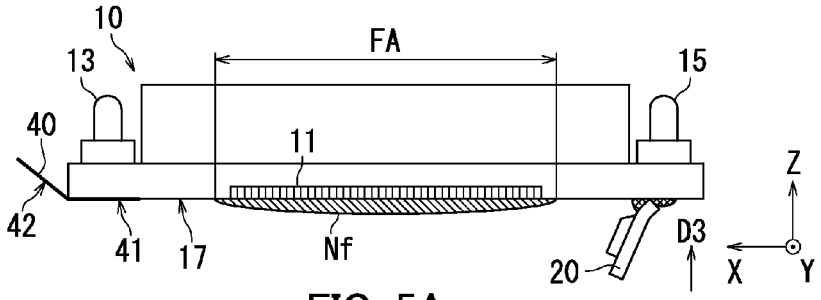
FIGS. 5A-5D are diagrams illustrating an operation of the wiper blade according to the embodiment.

Before the controller 50 causes the wiper blade 20 to wipe the ink discharge surface 17, the controller 50 in the present embodiment first causes the recording head 10 to perform purging to release fresh ink Nf (second ink) onto the ink discharge surface 17. The controller 50 then controls the movement mechanism 30 to move the wiper blade 20 in the ascending direction D3 so that the wiper blade 20 is pushed against the ink discharge surface 17 (FIG. 5A). Note that the wiper blade 20 is pushed against the ink discharge surface 17 at a location closer to the first end than a region FA of the ink discharge surface 17 where fresh ink Nf is released (hereinafter referred to as a start point).

Figure 5B:
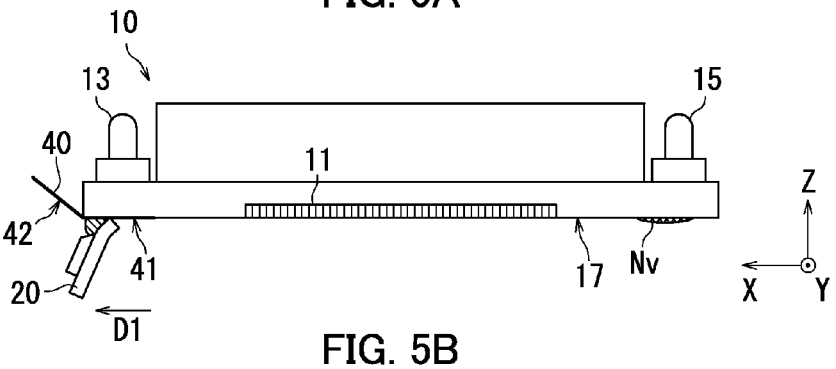
Figure 5C:
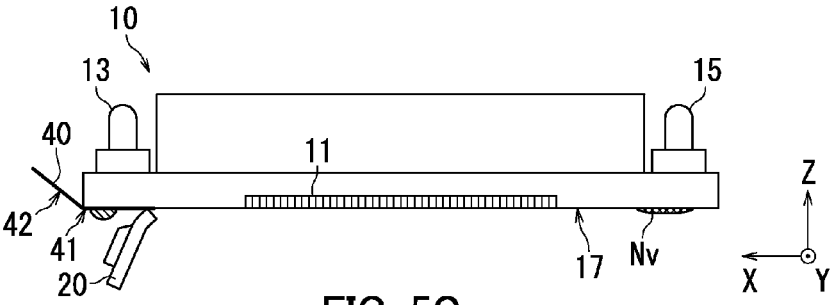

The controller 50 then causes the wiper blade 20 to perform first wiping. Specifically, the controller 50, by controlling the movement mechanism 30, causes the wiper blade 20 to move from the start point to the hydrophilic portion 41 in the first wiping direction D1 in a state in which the wiper blade 20 is pushed against the ink discharge surface 17 (FIG. 5B). Thereafter, the controller 50, by controlling the movement mechanism 30, causes the wiper blade 20 to move toward the region FA in the second wiping direction D2 in a state in which the wiper blade 20 is pushed against the ink discharge surface 17, and stop before the region FA. Thus, the fresh ink Nf released on the ink discharge surface 17 is conveyed to the second end and retained on the hydrophilic portion 41 (FIG. 5C). Note that not all the fresh ink Nf released on the ink discharge surface 17 is conveyed to the second end and part of the fresh ink Nf released on the ink discharge surface 17 flows downward along the wiper blade 20 upon receiving force generated due to movement of the wiper blade 20.

Figure 5D:
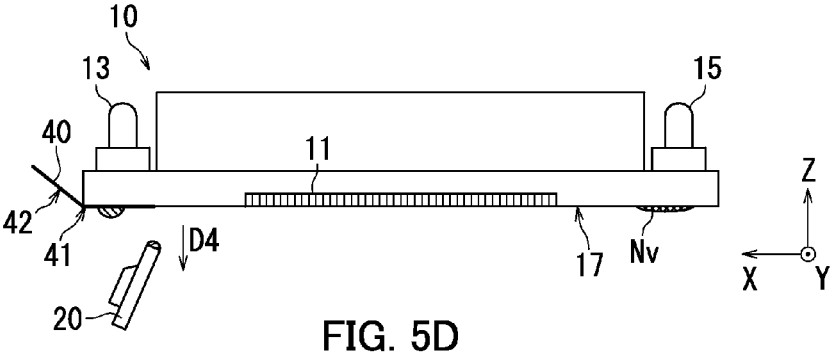
Figure 6A:
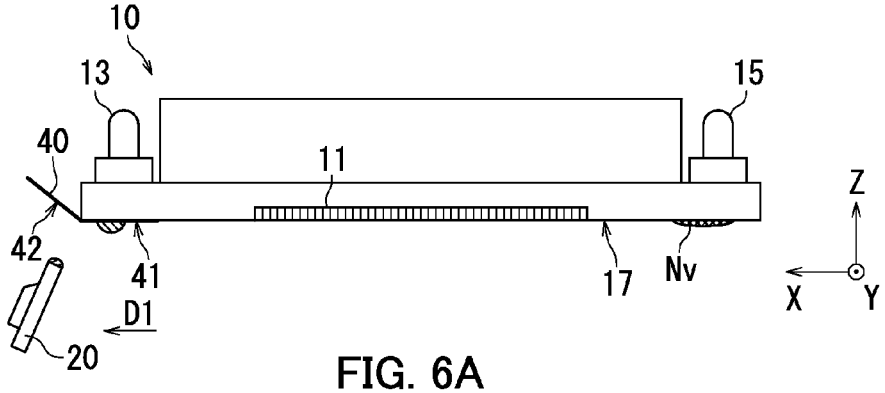
FIGS. 6A-6D are diagrams illustrating the operation of the wiper blade according to the embodiment.

The controller 50 controls the movement mechanism 30 to move the wiper blade 20 in the descending direction D4, thereby moving the wiper blade 20 downward from the ink discharge surface 17 (FIG. 5D). The controller 50, by controlling the movement mechanism 30, causes the wiper blade 20 to move in the first wiping direction D1 to a location directly below the repellent portion 42 (FIG. 6A).

Figure 6B:
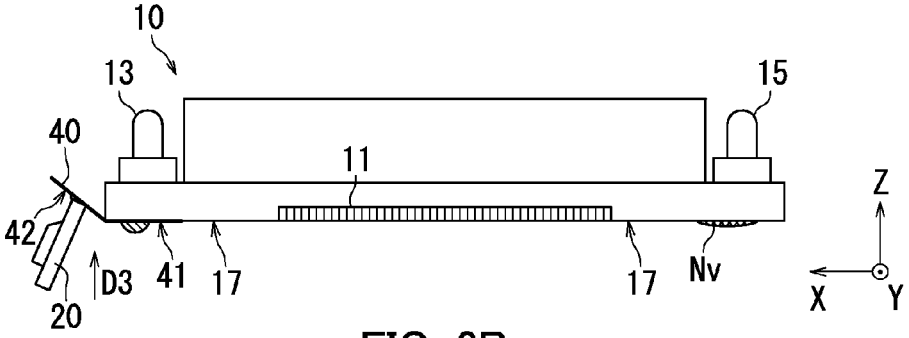

The controller 50 controls the movement mechanism 30 to move the wiper blade 20 in the ascending direction D3 to push the wiper blade 20 against the repellent portion 42 (FIG. 6B). The repellent portion 42 is disposed upstream of the hydrophilic portion 41, which retains the fresh ink Nf, in terms of the second wiping direction D2.

Figure 6C:
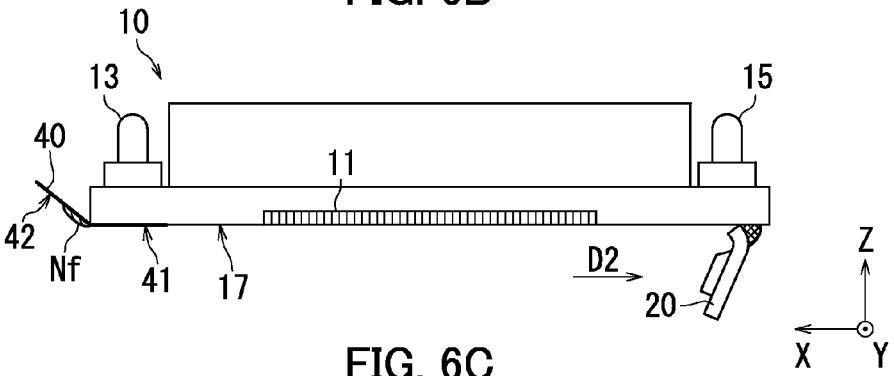

Thereafter, the controller 50 causes the wiper blade 20 to perform second wiping. Specifically, the controller 50, by controlling the movement mechanism 30, causes the wiper blade 20 to move to the first end in the second wiping direction D2 in a state in which the wiper blade 20 is pushed against the ink discharge surface 17 (FIG. 6C). Thus, the fresh ink Nf retained on the hydrophilic portion 41 is conveyed to the first end and mixed with residual ink Nv (first ink) to decrease viscosity of the residual ink Nv. Then, the residual ink Nv is removed from the ink discharge surface 17. Note that not all the fresh ink Nf retained on the hydrophilic portion 41 is conveyed to the first end and part of the fresh ink Nf retained on the hydrophilic portion 41 flows downward along the wiper blade 20 while the wiper blade 20 moves.

Figure 6D:
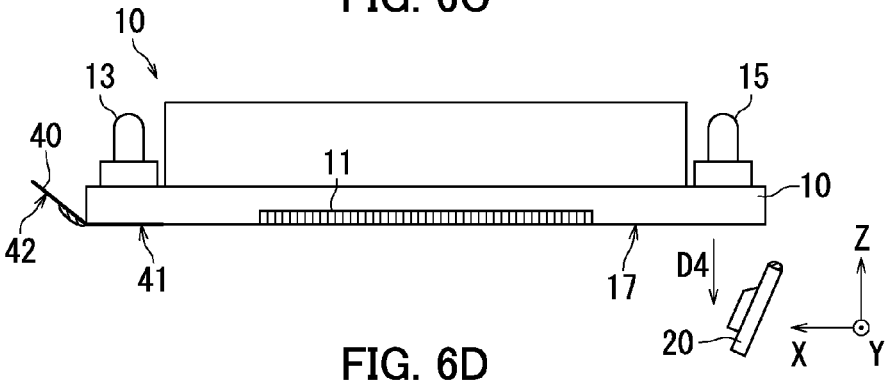

Then, the controller 50, by controlling the movement mechanism 30, causes the wiper blade 20 to move in the descending direction D4, thereby moving the wiper blade 20 downward from the ink discharge surface 17 (FIG. 6D).

Through the above processes, the inkjet recording apparatus 1 according to the present embodiment performs the first wiping and temporarily retains on the hydrophilic portion 41, fresh ink Nf released in purging. The inkjet recording apparatus 1 then performs the second wiping to wipe ink (residual ink Nv and fresh ink NO off the ink discharge surface 17 while conveying the fresh ink Nf retained on the hydrophilic portion 41.

As described above, the number of the nozzles 11 disposed in the central part of the ink discharge surface 17 in the width direction is slightly larger than that of the nozzles 11 disposed on each opposite side end part of the ink discharge surface 17 in the width direction. For this reason, an amount of fresh ink Nf released onto the central part of the ink discharge surface 17 in the width direction (hereinafter referred to as a central release amount) is larger than an amount of fresh ink Nf released onto each opposite side end part of the ink discharge surface 17 in the width direction (hereinafter referred to as a side release amount) in purging.

In a situation in which a simple flat plate-like wiper blade 20 is adopted in the above configuration, fresh ink Nf may not be retained uniformly over the entirety of the hydrophilic portion 41 in the first wiping. Specifically, the amount of fresh ink Nf retained at each opposite side end part of the hydrophilic portion 41 in the width direction (a direction perpendicular to the longitudinal direction of the ink discharge surface 17) is smaller than the amount of fresh ink Nf retained at the central part of the hydrophilic portion 41 in the width direction. Unless fresh ink Nf is retained uniformly over the entirety of the hydrophilic portion 41, the inkjet recording apparatus 1 cannot convey the fresh ink Nf evenly over the entirety of the ink discharge surface 17. As a result, the entire ink discharge surface 17 cannot be cleaned entirely. In view of the foregoing, the wiper blade 20 according to the present embodiment has a shape illustrated in FIGS. 7A and 7B.

Figure 7A:
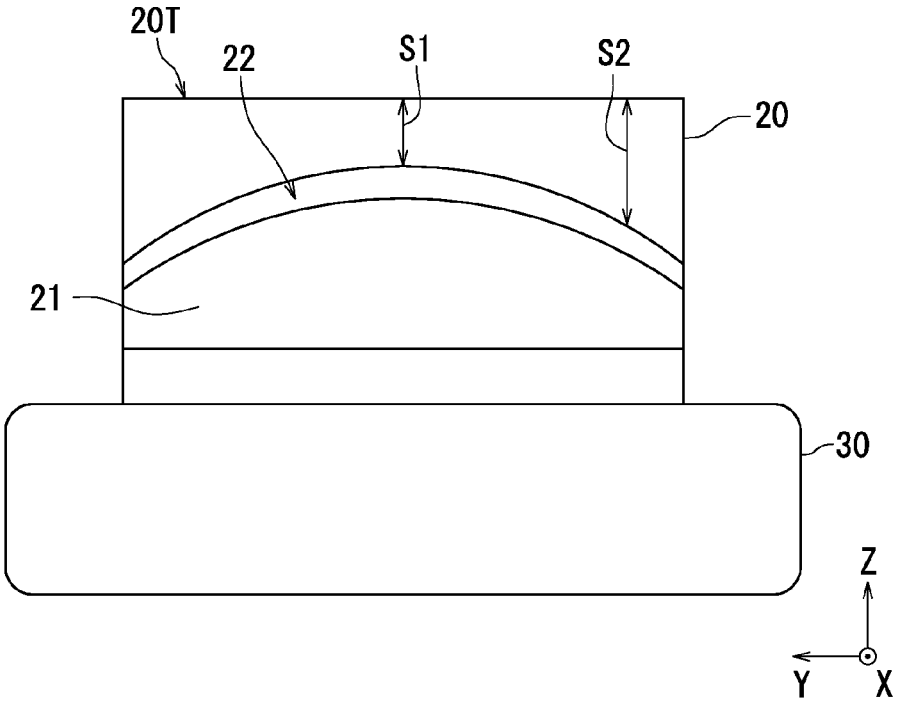
FIG. 7A is a front view of the wiper blade according to the embodiment.
Figure 7B:
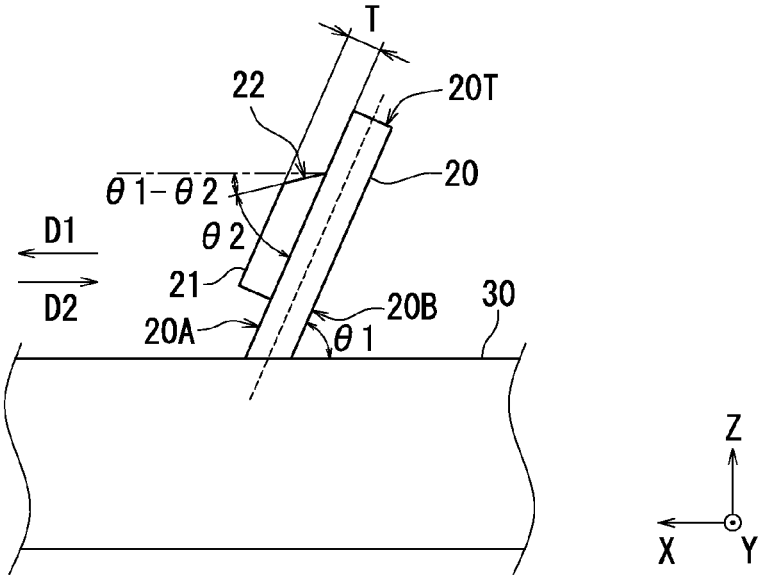
FIG. 7B is a side view of the wiper blade according to the embodiment.

FIG. 7A is a front view of the wiper blade 20 according to the embodiment. FIG. 7B is a side view of the wiper blade 20 according to the embodiment.

As illustrated in FIGS. 7A and 7B, the wiper blade 20 is in a flat plate-like shape and has a flat tip end (an end part that is pushed against the ink discharge surface 17) 20T. The wiper blade 20 may be elastic and, more specifically, may be made from, for example, synthetic rubber or synthetic resin. The wiper blade 20 in moving while being pushed against the ink discharge surface 17 is bent.

The back-and-forth direction where the wiper blade 20 is viewed from the front is a direction of the X axis. An angle between a front surface 20A (a first ink carrying surface) of the wiper blade 20 and the first wiping direction D1 is an obtuse angle, specifically, 180 degrees minus θ1. An angle between a rear surface 20B (a second ink carrying surface) of the wiper blade 20 and the second wiping direction D2 is an acute angle, specifically θ1. The front surface 20A of the wiper blade 20 carries ink on the ink discharge surface 17 while the wiper blade 20 moves in the first wiping direction D1. The rear surface 20B of the wiper blade 20 carries ink on the ink discharge surface 17 while the wiper blade 20 moves in the second wiping direction D2.

The wiper blade 20 in the present embodiment includes a protrusion 21 protruding in the first wiping direction D1 from the front surface 20A by a predetermined amount T. The protrusion 21 is integral with the wiper blade 20. The protrusion 21 has a surface (hereinafter referred to as an ink retaining surface) 22 that is inclined at a predetermined angle θ2 (e.g., 60 degrees) relative to the front surface 20A and that is connected to the front surface 20A. The ink retaining surface 22 faces the ink discharge surface 17 in the first wiping state. The angle θ2 is preferably between 50 degrees and 70 degrees. In other words, the angle θ2 is preferably set so that the ink retaining surface 22 is substantially parallel to the ink discharge surface 17 in the first wiping. Specifically, the angle (θ1-θ2) is preferably zero degrees to 20 degrees.

In the above configuration, an ink holding portion that holds ink on the ink discharge surface 17, especially fresh ink Nf, is contoured in the first wiping by the ink retaining surface 22, a region of the ink discharge surface 17 that faces the ink retaining surface 22 (hereinafter referred to as a confronting region), and a region of the front surface 20A between the ink retaining surface 22 and the confronting region. Thus, the wiper blade 20 can carry more fresh ink Nf in the first wiping than a configuration without the ink retaining surface 22. The ink retaining surface 22 is substantially parallel to the ink discharge surface 17 in the first wiping. As such, the ink holding portion in the above configuration can hold much fresh ink Nf. The wiper blade 20 is disposed aslant on the movement mechanism 30. This configuration can enable the ink holding portion to hold even more fresh ink Nf (see FIG. 5B). The angle (θ1-θ2) is set between zero degrees and 20 degrees. As a result, fresh ink Nf retained in the ink holding portion gradually flows down from the ink holding portion. Thus, a situation in which fresh ink Nf is retained in the ink holding portion for a long time and becomes residual ink Nv can be prevented.

The ink retaining surface 22 in the present embodiment curves such that a distance S1 and S2 from the ink retaining surface 22 to the tip end 20T of the wiper blade 20 increases from a central part toward opposite ends of the wiper blade 20 in the width direction of the wiper blade 20. In other words, the distance between the ink discharge surface 17 and the ink retaining surface 22 in the first state increases from the central part toward the opposite ends of the wiper blade 20 in the width direction of the wiper blade 20. The width direction of the wiper blade 20 herein coincides with a direction of a Y axis, that is, a direction perpendicular to the first wiping direction D1 and parallel to the ink discharge surface 17.

In the above configuration, the amount of fresh ink Nf carried by the wiper blade 20 in the first wiping increases from the central part toward the opposite ends of the wiper blade 20 in the width direction of the wiper blade 20. As such, even in a situation in which the central release amount is larger than the side release amount in purging, the inkjet recording apparatus 1 including the wiper blade 20 having the above configuration can retain fresh ink Nf uniformly on the entirety of the hydrophilic portion 41 through the first wiping. As a result, the inkjet recording apparatus 1 can evenly carry fresh ink Nf to the entirety of the ink discharge surface 17 in the second wiping, thereby achieving thorough cleaning on the entirety of the ink discharge surface 17.

The ink retaining surface 22 curves in an arc shape in the present embodiment. In the above configuration, the ink retaining surface 22 can be easily manufactured to curve such that the distance S1 and S2 from the ink retaining surface 22 to the tip end 20T of the wiper blade 20 increases from the central part toward the opposite side ends of the wiper blade 20 in the width direction of the wiper blade 20.

Although an embodiment of the present disclosure has been described so far, the present disclosure is not limited to the above embodiment. Various alterations can be made within the scope not departing from the subject matter of the present disclosure. Note that the drawings are schematic illustrations that emphasize elements of configuration in order to facilitate understanding thereof. Therefore, properties of each of the illustrated elements, such as thickness, length, and number thereof, may differ from actual properties of the element. Also, materials, shapes, dimensions, etc. of the respective elements indicated in the embodiment are examples and are not intended to limit the present embodiment.

For example, the recording medium is paper P in the present embodiment, which however should not be taken to limit the present disclosure. The recording medium may be any other medium on which the recording head 10 can form an image, such as an envelope or fabric.

What is claimed is:

1. An inkjet recording apparatus comprising:

a recording head having an ink discharge surface and configured to discharge ink onto a recording medium;

a wiper blade configured to clean the ink discharge surface of the recording head;

a movement mechanism configured to move the wiper blade along the ink discharge surface; and a controller configured to cause the wiper blade to wipe ink off the ink discharge surface by causing the wiper blade to be pushed against the ink discharge surface and move in a first direction and a second direction opposite to the first direction, wherein the wiper blade is elastic, the wiper blade is disposed aslant on the movement mechanism relative to a direction perpendicular to the ink discharge surface, the wiper blade includes:

a first ink carrying surface that extends in a direction perpendicular to the first direction and that is configured to carry ink on the ink discharge surface while the wiper blade moves in the first direction;

a second ink carrying surface that extends in a direction perpendicular to the second direction and that is configured to carry ink on the ink discharge surface while the wiper blade moves in the second direction; and a protrusion protruding in the first direction from the first ink carrying surface, the protrusion has an ink retaining surface inclined at a predetermined angle relative to the first ink carrying surface and connected to the first ink carrying surface, the ink retaining surface retains ink in cooperation with the ink discharge surface and curves such that a distance from the ink retaining surface to a tip end of the wiper blade increases from a central part toward opposite ends of the wiper blade in a width direction of the wiper blade, and the width direction of the wiper blade is perpendicular to the first direction and parallel to the ink discharge surface.

2. The inkjet recording apparatus according to claim 1, wherein ink on the ink discharge surface includes a first ink and a second ink, the first ink being ink attached to the ink discharge surface and increased in viscosity, the second ink being ink released for removing the first ink and not increased in viscosity, the first direction is a direction from one side end to another side end of the ink discharge surface, the second direction is a direction from the other side end to the one side end of the ink discharge surface, an ink retaining portion capable of retaining the second ink is disposed at the other side end of the ink discharge surface, and the controller causes the wiper blade to carry the second ink released on the ink discharge surface to the other side end of the ink discharge surface by causing the wiper blade to be pushed against the ink discharge surface and move in the first direction so that the second ink is retained on the ink retaining portion, and causes the wiper blade to carry the second ink retained on the ink retaining portion to the one side end of the ink discharge surface by causing the wiper blade to be pushed against the ink discharge surface and move in the second direction so that the first ink is removed from the ink discharge surface.

3. The inkjet recording apparatus according to claim 2, wherein the ink retaining portion has hydrophilicity higher than the ink discharge surface.

4. The inkjet recording apparatus according to claim 1, wherein in a state in which the wiper blade moves in the first direction while being pushed against the ink discharge surface, the ink retaining surface of the wiper blade faces the ink discharge surface, and a distance between the ink discharge surface of the recording head and the ink retaining surface of the wiper blade increases from the central part toward the opposite ends of the wiper blade in the width direction of the wiper blade.

5. The inkjet recording apparatus according to claim 4, wherein the wiper blade is bent in the state in which the wiper blade moves in the first direction while being pushed against the ink discharge surface.

6. The inkjet recording apparatus according to claim 1, wherein the wiper blade is disposed aslant such that an angle between the first ink carrying surface of the wiper blade and the ink discharge surface is acute.

7. The inkjet recording apparatus according to claim 1, wherein the ink retaining surface of the wiper blade curves in an arc shape.

8. The inkjet recording apparatus according to claim 1, wherein the wiper blade is disposed on the movement mechanism such that an angle of the wiper blade relative to the ink discharge surface is in a range from 60 degrees to 80 degrees.

9. An inkjet recording apparatus comprising:

a recording head having an ink discharge surface and configured to discharge ink onto a recording medium;

a wiper blade configured to clean the ink discharge surface of the recording head; and a controller configured to cause the wiper blade to wipe ink off the ink discharge surface by causing the wiper blade to be pushed against the ink discharge surface and move in a first direction and a second direction opposite to the first direction, wherein the wiper blade includes:

a first ink carrying surface that extends in a direction perpendicular to the first direction and that is configured to carry ink on the ink discharge surface while the wiper blade moves in the first direction;

a second ink carrying surface that extends in a direction perpendicular to the second direction and that is configured to carry ink on the ink discharge surface while the wiper blade moves in the second direction; and a protrusion protruding in the first direction from the first ink carrying surface, the protrusion has an ink retaining surface inclined at a predetermined angle relative to the first ink carrying surface and connected to the first ink carrying surface, the ink retaining surface curves such that a distance from the ink retaining surface to a tip end of the wiper blade increases from a central part toward opposite ends of the wiper blade in a width direction of the wiper blade, the width direction of the wiper blade is perpendicular to the first direction and parallel to the ink discharge surface, ink on the ink discharge surface includes a first ink and a second ink, the first ink being ink attached to the ink discharge surface and increased in viscosity, the second ink being ink released for removing the first ink and not increased in viscosity, the first direction is a direction from one side end to another side end of the ink discharge surface, the second direction is a direction from the other side end to the one side end of the ink discharge surface, an ink retaining portion capable of retaining the second ink is disposed at the other side end of the ink discharge surface, and the controller causes the wiper blade to carry the second ink released on the ink discharge surface to the other side end of the ink discharge surface by causing the wiper blade to be pushed against the ink discharge surface and move in the first direction so that the second ink is retained on the ink retaining portion, and causes the wiper blade to carry the second ink retained on the ink retaining portion to the one side end of the ink discharge surface by causing the wiper blade to be pushed against the ink discharge surface and move in the second direction so that the first ink is removed from the ink discharge surface.

* * * * *